US010906614B2

(12) United States Patent
Sebastjan

(10) Patent No.: US 10,906,614 B2
(45) Date of Patent: Feb. 2, 2021

(54) PIECE OF INFLATABLE SPORTS EQUIPMENT, PREFERABLY FOR WATER SPORTS

(71) Applicants: SIPABOARDS D.O.O., Kamnik (SI); Sitar Sebastjan, Stahovica (SI)

(72) Inventor: Sitar Sebastjan, Stahovica (SI)

(73) Assignee: Sipaboards D.O.O., Kamnik (SI)

( * ) Notice: Subject to any disclaimer, the term of this patent is extended or adjusted under 35 U.S.C. 154(b) by 0 days.

(21) Appl. No.: 16/321,104

(22) PCT Filed: Jul. 17, 2017

(86) PCT No.: PCT/IB2017/000834

§ 371 (c)(1),
(2) Date: Jan. 28, 2019

(87) PCT Pub. No.: WO2018/020308

PCT Pub. Date: Feb. 1, 2018

(65) Prior Publication Data

US 2019/0168849 A1 Jun. 6, 2019

(51) Int. Cl.
*B63B 32/51* (2020.01)
*B63B 32/66* (2020.01)

(52) U.S. Cl.
CPC ..... *B63B 32/51* (2020.02); *B63B 32/66* (2020.02)

(58) Field of Classification Search
CPC ..... B60F 3/0061; B60F 3/0007; B60F 3/003; B60F 3/0038; B60F 3/00; B63B 32/51; B63B 32/66
See application file for complete search history.

(56) References Cited

U.S. PATENT DOCUMENTS

2004/0187761 A1* 9/2004 Godek ..... B63B 43/14 114/347
2008/0080734 A1* 4/2008 Forth ..... H04R 1/021 381/386
2011/0009020 A1* 1/2011 Withers ..... B63C 9/1255 441/118
2013/0059489 A1 3/2013 Vlock et al.

FOREIGN PATENT DOCUMENTS

DE 2155978 A1 5/1973
DE 102015103503 A1 4/2016
WO 2014164522 A1 10/2014
WO 2016099406 A1 6/2016
WO 2016175709 A1 11/2016

* cited by examiner

*Primary Examiner* — Stephen P Avila
(74) *Attorney, Agent, or Firm* — The Watson IP Group, PLC; Jovan N. Jovanovic

(57) ABSTRACT

A piece of inflatable sports equipment, preferably for water sports, is provided with a board (1) which can be inflated with a gaseous medium, preferable air, by means of a pump unit (6) having a compressor (7). The pump unit (6) is integrated together with the compressor (7) in the board (1) and preferably comprises assemblies (8, 9, 11) which drive the compressor and are installed together in a housing (12) which can be removed from and inserted into the board (1) and fastened therein. Inflation of the board can therefore be carried out anywhere and at any time during use of the board, since the means necessary for this are installed in the board itself.

12 Claims, 3 Drawing Sheets

PIECE OF INFLATABLE SPORTS EQUIPMENT, PREFERABLY FOR WATER SPORTS

Figure 1:
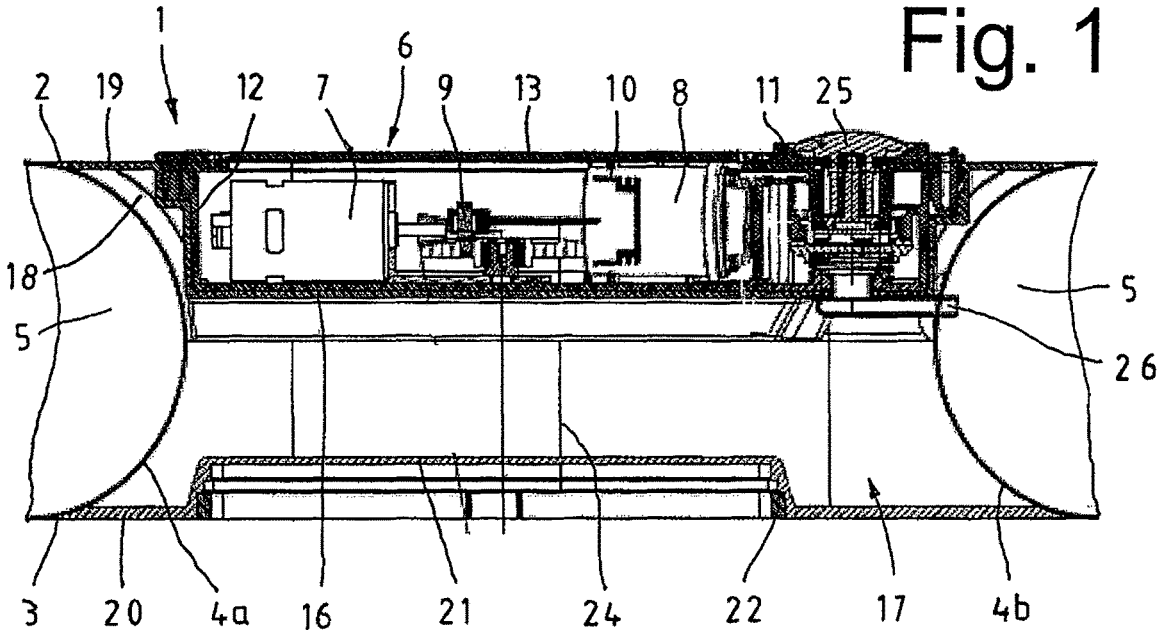

The object of the invention is a piece of inflatable sports equipment, preferably for water sports, provided with a board that can be inflated with a gaseous medium, preferably air, by means of a pump unit with a compressor.

Known pieces of sports equipment developed as boards are, for instance, used as SUP watercraft (stand-up paddle-boards), with a length of up to 5 m. Due to such great length, it is more convenient for the purpose of transport if the air can be discharged from the board and the board can be rolled up. Conventional boards of this kind are inflated either manually, using an appropriate air pump, or by means of an external compressor. This can be very cumbersome and, if using a manual pump, time consuming and straining.

The invention provides a means for avoiding these disadvantages and for creating a piece of sports equipment of the aforementioned kind such that can be inflated quickly and easily, and offers the possibility of automatically reaching the desired inflation pressure.

This object is accomplished according to the present invention by the fact that the pump unit is embedded in the board with the compressor.

The board can therefore be inflated anywhere and anytime, since the means necessary for this are built into the board itself. Apart from this, it is possible to control the compressor so that it ensures compliance with the respective level of inflation.

For design reasons, it is highly advantageous if the compressor, together with the electronics necessary for automated operation, forms a pump unit installed in a housing that can be removed from and inserted into the board. This way the pump unit can be removed from the board en bloc so it can be used to externally inflate other pieces of sports equipment or for overhaul or repair purposes thereof.

In order to control the inflation pressure in the board, the pump unit according to the invention is provided with a bidirectional intake and outtake valve comprised in the housing, which either manually or automatically manages the supply and exhaust of compressed air to or from the inside of the board.

To protect the pump unit during use of the board, it is useful if its housing can be sealed with a removable or hinged cover so the pump unit is watertight.

To facilitate the pump unit's operation, the invention provides that the pump's intake/outtake valve is equipped with an actuating medium, built into the cover and easily accessible, with the pumping action controllable without having to remove the cover.

To maintain a constant level of inflation pressure, the pump unit can be equipped with a pressure control by means of which, combined with a preferably adjustable pressure regulator, the compressor and/or the pump unit's intake/outtake valve can be automatically controlled.

In order to secure the pump unit to the board, the invention provides that the board is equipped with a shell, which perfectly fits the housing of the pump unit, preferably made of PVC material.

Inflatable boards of the aforementioned kind generally contain at least one wall between one upper and one bottom outer wall with an inflatable air chamber which, when inflated, defines the board's shape and rigidity of the board. The outer wall and the inner walls of the board are generally made of foil-like plastic materials.

The invention provides that there is a free opening extending between the two outer walls in order to fit the shell for the housing of the pump unit inside the board, whereby the latter is preferably made of PVC material and, when installed, is glued or thermally adhered to the upper outer wall and/or the wall of the board. According to the specific characteristics of the board, it is generally considered an advantage if the pump unit's shell and housing are designed in such a way that, when installed, the cover of the housing is flush with the upper outer wall of the board.

The invention also provides that the opening for the housing at the bottom end is sealed by means of a base plate with a slot, a so-called fin box, which houses the board's fin, provided that the base plate is preferably made of PVC material as well and, when installed, is glued or thermally adhered to the bottom outer wall and/or the inner wall of the board.

For the purpose of directly supplying compressed air to the inner part of the board, the invention provides that the pump unit's intake/outtake valve is equipped with a mouthpiece protruding into the air chamber of the wall which on the one hand can be connected to the shell for the pump unit, whereas on the other hand it is thermally adhered or glued onto the wall of the wall.

Figure 2:
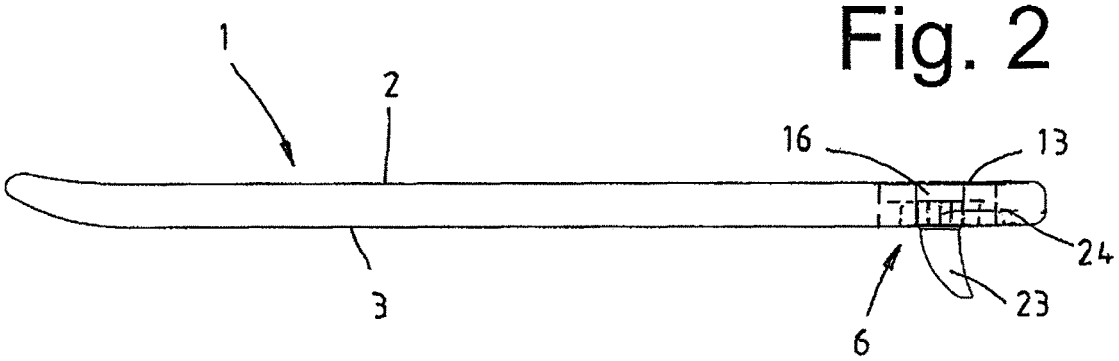
Figure 3:
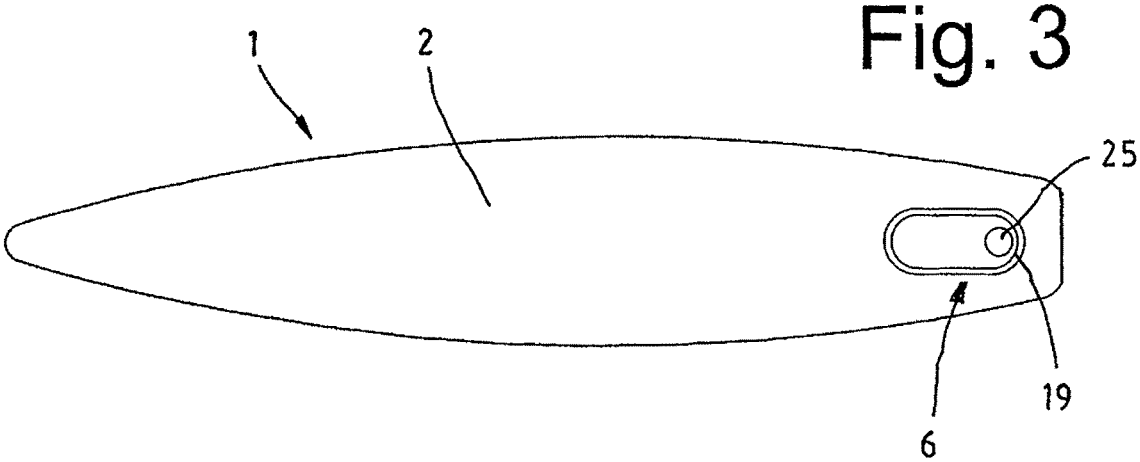
Figure 4:
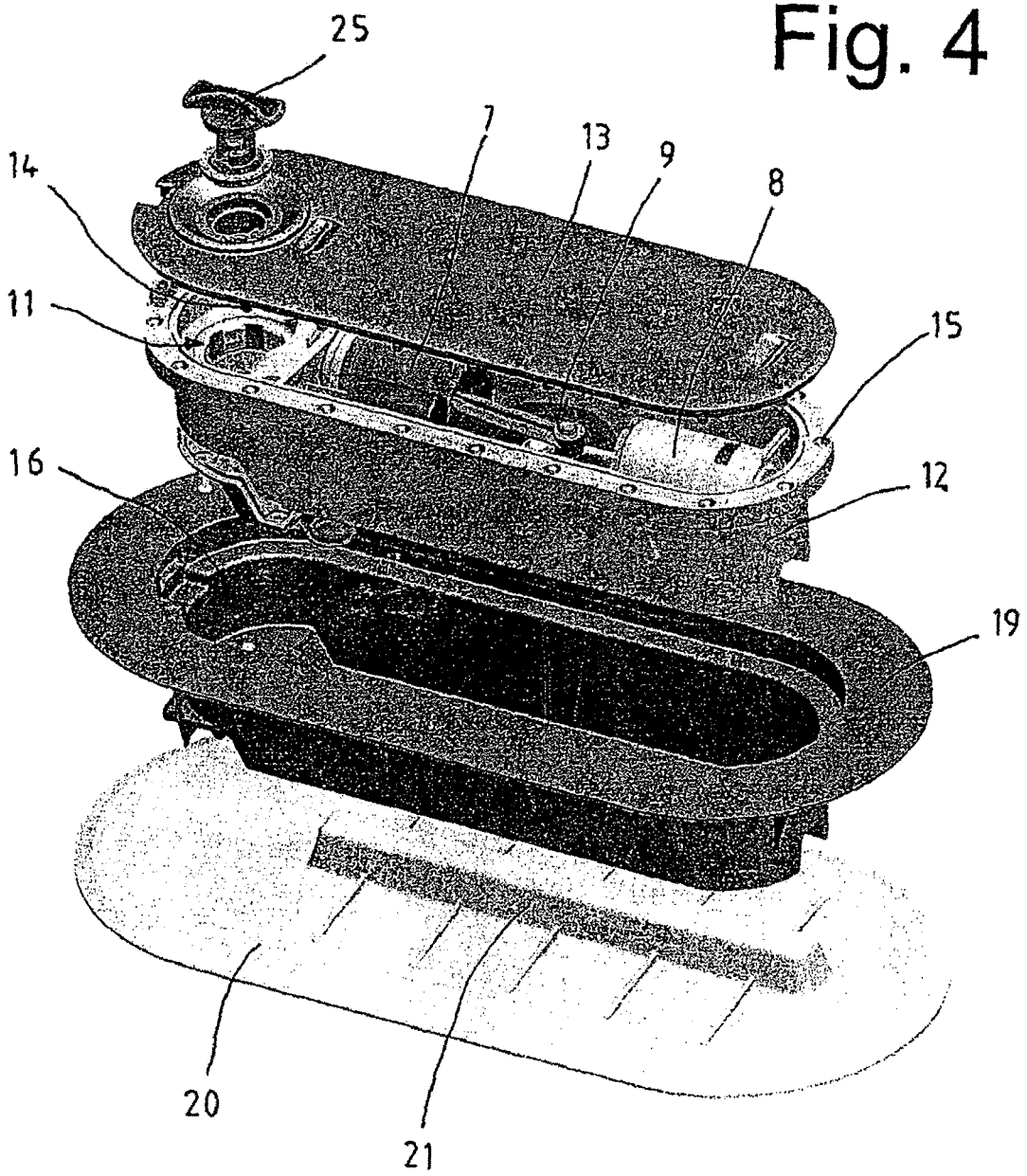
Figure 5:
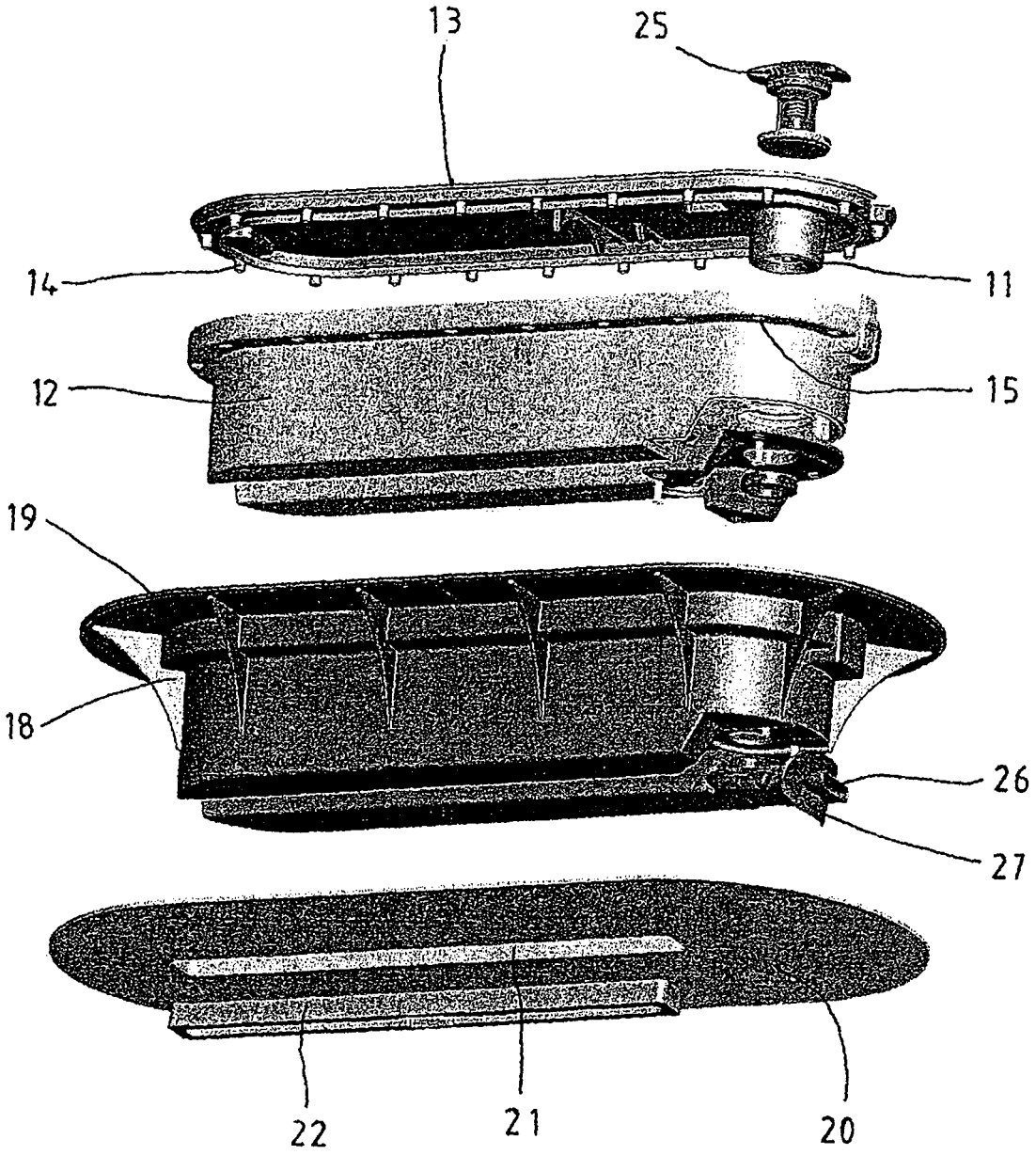

The invention will be explained in more detail by the mock-up and the enclosed drawings, representing in:

FIG. 1: a longitudinal view of the piece of sports equipment with a pump unit;

FIG. 2: a side view of the board of the piece of sports equipment with the indicated pump unit;

FIG. 3: the board according to FIG. 2—top view;

FIG. 4: the pump unit according to FIG. 1 in a zoom view illustrated from above;

FIG. 5: the pump unit according to FIG. 1 in a zoom view illustrated from below.

The inflatable piece of sports equipment according to FIG. 1 to FIG. 3 essentially consists of a board 1, which in its inner part comprises a wall 4*a*, 4*b* lying between an upper and a bottom outer wall 2 or 3, and whose air chamber 5 is inflatable by means of a pump unit 6, and, when inflated, defines the outer shape of the board. The outer walls 2, 3, as well as the wall 4*a*, 4*b* are made of foil-like plastic material.

Such an inflatable piece of sports equipment is also suitable for winter sports and can be used in a similar way as a sledge on snow or ice.

The pump unit 6 of the invention is embedded in the board 1. It comprises a compressor 7 and, necessary for its automated operation, generally an electric motor 8 for driving the compressor, a battery, although not visible in FIG. 3, for feeding the motor, and a gear 9 for converting the rotary movement of the motor in a linear movement of the piston 10 of the compressor.

The pump unit 1 further comprises a manually operated intake/outtake valve 11, controlling the supply and exhaust of the compressed air of the compressor 7 to or from the air chamber 5 of the wall 4*a*, 4*b*.

The pump unit 6 is installed in a housing 12 made of PVC material, which can be removed from the board 1. This way the pump unit can be removed en bloc for the inspection, repair, or maintenance thereof. To protect the pump unit 6 from external impacts, the housing 12 is covered by a removable cover 13 made of PVC. To hold the cover, it is provided with knobs 14, which can be snapped in the corresponding drillings 15 of the housing 12.

In order to fasten the pump unit 6 in the board 1, the invention provides a shell 16 which positively fits the housing 12 which is, as can be seen in FIG. 4, also made of PVC material. It is embedded in the board 1 in a free opening 17 extending between the two outer walls 2 and 3. The shell 16 has an outside flange 19, reinforced with panels 18, which is welded or glued to the upper outer wall 2 and/or the inner wall 4*a*, 4*b* for fastening.

The shell 16 and the housing 12 are designed in such a way that, when installed, the cover 13 of the housing is largely flush with the upper outer wall 2. This has fluidic advantages. However, for other, e.g. sport-specific reasons, arrangements of the shell can come into consideration in which it protrudes from the outer wall of the board.

In the context of the invention, the shell 16 in the board 1 with an upper opening allows for the pump unit 6 to be removed after inflation of the board for weight relief or creating more space and achieving that the piece of sports equipment can glide on the water either with an empty shell or with a shell filled with items such as drinks, bathing towels, bags, or the like. Preferably this shell could also be sealed with a removable cover, which is not examined in more detail, so that no water can enter from the outside.

The opening 17 is sealed by means of a base plate 20 with a fin guide 21 at the bottom end for the take-up of a box girder 22 for the keel 23 (fin). The base plate 20 is thermally adhered or glued to the bottom outer wall 3 and/or the wall 4*a*, 4*b*. The latter and the box girder 22 are made of PVC material as well. Between the plate and the shell 16 for the pump unit 6, plastic strips 24 are provided.

The intake/outtake valve 11 is equipped with an actuating medium 25, which is stored within easy access to the cover 13 and by which the pump and/or the valve is operated manually. This intake/outtake valve 11 is not examined in more detail. However, its actuating medium 25 can be conveniently opened or closed with a twist: by doing so, a check valve can be opened, which otherwise prevents discharge of the medium from the chamber 5.

The pump unit 6 can also be equipped with an air pressure control by means of which, combined with a preferably adjustable pressure regulator, the operation of the compressor and/or of the valve can be automatically controlled.

According to FIG. 5, for the purpose of direct supply of compressed air to the inside of the board, the intake/outtake valve 11 is equipped with a mouthpiece 26 protruding into the air chamber 5 of the wall 4*a*, 4*b* which on the one hand can be connected to the shell 16 for the pump unit 6, whereas on the other hand it provides a frame, 27 which is hermetically thermally adhered or glued onto the wall of the wall 4*b*.

In the present configuration, the pump unit 6 is arranged in the back of the board 1, as this is advantageous for boards with a fin, for instance stand-up paddles. However, the arrangement can vary according to the piece of sports equipment. The pump unit, for example, can also be placed at the centre of the board.

The arrangement of an automatic pump unit in the inflatable piece of sports equipment allows for its inflation anytime regardless its location and without elaborate handling. While the pump unit inflates the board, the user can be otherwise engaged. It also allows for modifying the inflation pressure as well as for automatically keeping it at a constant level while using the piece of sports equipment. Furthermore, the arrangement of the pump unit facilitates inspection and maintenance, either in situ after removing the cover 13 or at the workshop after disassembling the pump unit either en bloc or in its individual components.

Very advantageous is the upper bridge, together with the bottom outer wall 2, 3 distributed over the entire area and connected by means of thread-like transverse joining elements which are of such a length that these joining elements cause restricted opening of the board and thus a defined thickness of the board in its inflated state. In the area of the shell 16, the space between the outer walls is additionally limited due to its attachment to base plate 20, fastened at the bottom outer wall 3.

Of course, the invention could be elaborated by further configurations. Thus in principle the pump unit could be equipped with a different pump, for instance a rotary piston pump, a gear pump, or the like. Similarly, the pump could be developed in such a way that, if required, it could be manually operated.

In principle, the pump unit could also be comprised directly in one of the housings connected with the upper and the bottom outer wall, which might not be expandable.

The invention claimed is:

1. An inflatable piece of sports equipment, comprising:

a board including an air chamber that is inflatable with a gaseous medium;

a pump unit having a compressor, the pump unit being integrated in the board and filling the air chamber with the gaseous medium; and an intake/outtake valve equipped with a mouthpiece connected to a shell of the pump unit and providing a frame which is coupled to a wall of the air chamber, the intake/outtake value controlling supply of the gaseous medium to and from the air chamber of the inflatable piece of sports equipment and the mouthpiece for manual supply of the gaseous medium to the air chamber.

2. The inflatable piece of sports equipment according to claim 1, wherein the pump unit comprises the compressor and the assemblies driving it, installed together in a housing which can be removed from or inserted into and fastened in the board.

3. The inflatable piece of sports equipment according to claim 2, wherein the pump unit is provided with an intake/outtake valve comprised in the housing for either the manual or automatic supply and exhaust of the gaseous medium from the air chamber.

4. The inflatable piece of sports equipment according to claim 2, wherein the housing comprises a removable cover, whereby after removing it the pump unit and the compressor, as well as the assemblies, are accessible or removable separately or en bloc.

5. The inflatable piece of sports equipment according to claim 1, wherein the intake/outtake valve is assigned an actuating medium, which is accessible at the top of the cover.

6. The inflatable piece of sports equipment according to claim 1, wherein the pump unit is equipped with a pressure control, by means of which the compressor and/or of the intake/outtake valve of the pump unit is controlled.

7. The inflatable piece of sports equipment according to claim 1, wherein the board is equipped with a shell, taking up the housing with the pump unit, that is made of PVC material.

8. The inflatable piece of sports equipment according to claim 1, wherein the board includes at least one opening extending between its upper and bottom outer wall for housing the shell, whereby the latter is made of PVC material and, when installed, is glued or thermally adhered to the upper and bottom outer wall and/or the wall.

9. The inflatable piece of sports equipment according to claim 8, wherein the cover of the housing is largely flush with the upper outer wall of the board.

10. The inflatable piece of sports equipment according to claim 8, further comprising a retainer for a fin, protruding downwards at the bottom end of the opening.

11. The inflatable piece of sports equipment according to claim 10, wherein the retainer provides retention at the bottom end of the shell by means of a base plate with a fin guide for the take-up of a box girder for the fin, wherein the base plate is made of PVC material and, when installed, is fastened in the bottom outer wall and/or the wall of the board.

12. The inflatable piece of sports equipment according to claim 3, wherein the intake/outtake valve of the pump unit is equipped with an insert protruding into the air chamber of the wall of the board, which on the one hand can be connected to the shell for the pump unit, whereas on the other hand is hermetically fastened onto the wall of the wall.

* * * * *